United States Patent [19]

Gross

[11] 4,142,433

[45] Mar. 6, 1979

[54] AUTOMATIC BASS CHORD SYSTEM

[75] Inventor: Ulrich Gross, Aachen, Fed. Rep. of Germany

[73] Assignee: U.S. Philips Corporation, New York, N.Y.

[21] Appl. No.: 719,988

[22] Filed: Sep. 2, 1976

[30] Foreign Application Priority Data

Sep. 9, 1975 [DE] Fed. Rep. of Germany ..... 2539950

[51] Int. Cl.[2] ..... G10F 1/00

[52] U.S. Cl. ..... 84/1.03; 84/1.01; 84/1.17; 84/1.24; 84/DIG. 22

[58] Field of Search ..... 84/1.01, 1.03, 1.24, 84/1.17, DIG. 22

[56] References Cited

U.S. PATENT DOCUMENTS

| | | | |
|---|---|---|---|
| 3,697,661 | 10/1972 | Deutsch | 84/1.01 |
| 3,871,247 | 3/1975 | Bonham | 84/1.03 X |
| 3,986,424 | 10/1976 | Sakashita | 84/1.03 |
| 3,990,339 | 11/1976 | Robinson et al. | 84/1.17 |
| 4,011,784 | 3/1977 | Fukui | 84/1.03 X |

*Primary Examiner*—Ulysses Weldon

*Attorney, Agent, or Firm*—David R Treacy; Bernard Franzblau

[57] ABSTRACT

In order to simplify the intricate wiring in known automatic bass chord systems and to reduce the number of separate decoders used therein for all chords of each key, an apparatus is provided which allows the use of only one decoder per chord type. When a chord is held one bit is applied to the inputs of a first 12-bit shaft register which correspond to the tones of the chord, after which all bits are shifted further by an HF clock pulse until this chord pattern has arrived at those outputs of the 12-bit shift register which, with the inputs of the decoder which corresponds to the chord being held, are assigned to a single pre-selected tonality.

10 Claims, 8 Drawing Figures

AUTOMATIC BASS CHORD SYSTEM

Figure 1:
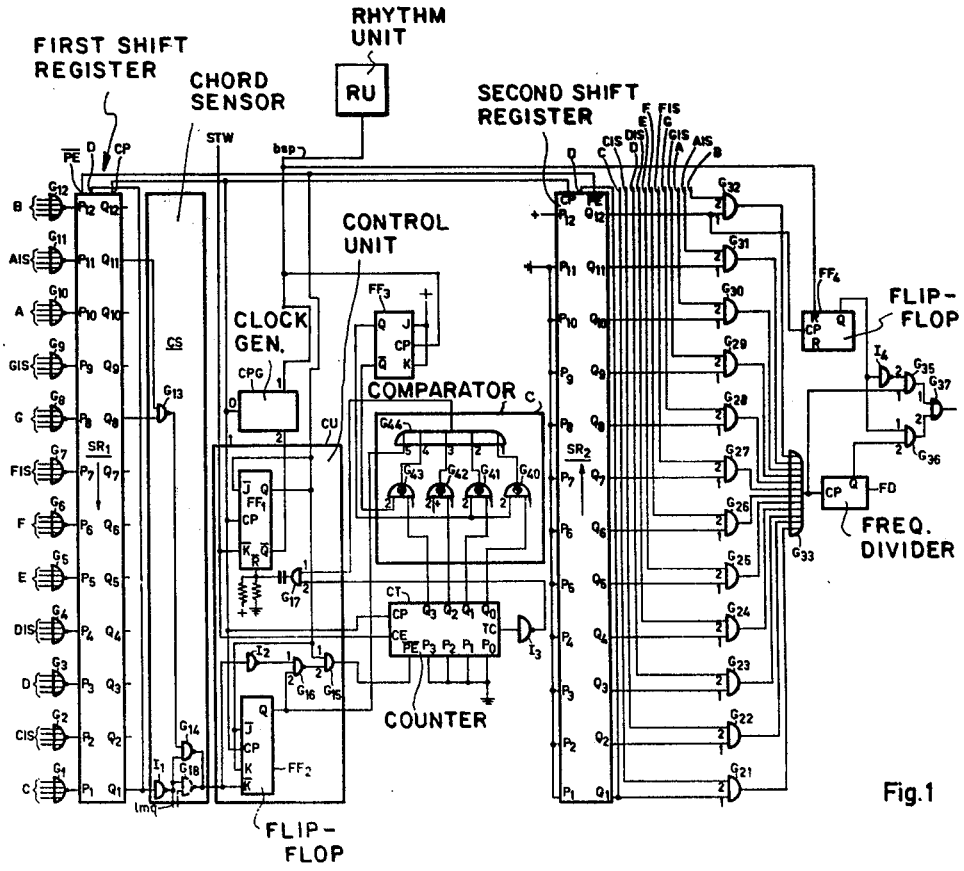

The invention relates to a device for automatically playing a tonal accompaniment in electronic musical instruments equipped with a rhythm unit, the fundamental, the quint, or another tone related to a chord being held and/or the chord itself becoming available in a predetermined sequence in the selected rhythm.

Such a device is known from U.S. Pat. No. 3,567,838. This device selects the highest and the lowest tone from the chords being held and reproduces these tones alternatively with the chords. A drawback of this device is that when an inversion of a chord is depressed, i.e. for example in the case of the C-major chord C E G the first inversion E C G, not the fundamental and the quint will sound, as desired, but the third and octave of the fundamental. Moreover, the wiring of this instrument is highly complicated because a separate decoder is provided for each chords in every key.

It is an object of the invention to simplify the wiring substantially and to reduce the number of decoders appreciably.

According to the invention this object is achieved in that for the outputs of the key switches within an octave parallel inputs of a first 12-bit shift register connected in a ring are provided, in which the chord pattern is stored upon receipt of each bass pulse of the rhythm unit. Those outputs, to which the tones of the chords of a single key to be reproduced correspond, lead to inputs of a chord sensor, which determines the chord type. An HF (High Frequency) clock generator is provided whose output is connected both to the clock input of the first 12-bit shift register, shifting the chord pattern one position further upon each clock pulse, and to the clock input of a second 12-bit shift register also connected in a ring, into which a single bit is entered upon each bass pulse via its 12 parallel inputs, which bit is shifted one position further upon each clock pulse of the clock generator. The outputs of this shift register are each connected to a first input of a first gate circuit, to whose second input the corresponding tone is applied and whose output leads to a second gate circuit at whose output a tone is available. A control section is provided which is connected to the HF clock generator and may include a chord memory which chord the detected stores and is connected to the output of the chord sensor. The clock input of the first 12-bit shift register is disconnected from the HF clock generator when a cord is detected, and the control section makes the HF clock generator, which is rendered operative upon each bass pulse applied to a first input, inoperative as soon as the bit in the second 12-bit shift register reaches the position which corresponds to the desired tone in the key which is dictated by the chord.

The clock pulse generator can be made operative and inoperative by simply switching it on and off respectively or by enabling and inhibiting respectively its supply of pulses to the other part by means of a gate circuit or a switch.

As a result, it is possible to use only one decoder per chord type because when a chord is depressed it is applied to the inputs of the first 12-bit shift register which correspond to the tones of the chord, after which, all bits are shifted by the HF clock pulse until this chord pattern has reached those outputs of the 12-bit shift register which with the inputs of the decoder which corresponds to the chord being held, are assigned to a single pre-selected key. The number of steps needed by the chord pattern to pass from its initial position to its final position defines the relative position, i.e. the key of the depressed chord, with respect to the pre-selected key.

In accordance with an embodiment of the invention the output of the chord memory is connected via a second output of the control section to a reset input of a counter whose clock input is also connected to the HF clock generator, and also to a comparator circuit whose first inputs are connected to the corresponding outputs of the counter, and whose second inputs are connected to a switch which is switched over by each base pulse. The output of the comparator circuit is connected to a third input of the control section so that the clock generator is alternatively disabled upon reaching a counter position which corresponds to the fundamental or another tone respectively.

Thus, it becomes possible to alternately reproduce the fundamental of the depressed chord and the alternating bass of the chord, which is generally the quint of the chord, at the instants which are pre-selected by the rhythm unit. Consequently, this process is performed upon every bass pulse. At a very high speed which is determined by the frequency of the HF clock generator, after which the resulting tone is released for reproduction. The switch which is changed over by each bass pulse alternately changes the predetermined number at the second inputs of the comparator circuit in accordance with the number of steps of the second 12-bit shift register so that this register is alternately stopped at the output of the associated fundamental and the associated quint or an other selected tone, for example the seventh.

With this circuit arrangement it is not yet possible to obtain arbitrary alternating-bass patterns. This is achieved by means of a further embodiment of the invention in which, instead of the switch, a programme memory is provided having a first input to which the bass pulses are applied, which each advance the programme memory one position and whose outputs are connected to the second inputs of the comparator circuit. Thus, it is also possible to programme, for example, a boogie bass pattern.

In a different embodiment of the invention the control section is an on/off switch which renders the clock generator operative upon each bass pulse and which renders it inoperative again via the chord sensor output when the chord is detected. A programme memory is provided whose 12 outputs, which each correspond to one tone of an actave, are connected to the corresponding parallel inputs of the second 12-bit shift register. The bass pulses to be transferred are applied to an input of said programme memory so that the tone output corresponding to the relevant instant is released.

As a result of this, a separate counter may be dispensed with and the circuit can be simplified.

In accordance with a further embodiment of the invention the decoder outputs corresponding to the various rhythm clock-pulse patterns in the rhythm unit are connected to the parallel input which corresponds to the desired tone of the second 12-bit shift register.

This makes it possible to employ the programme memory which is already present in the rhythm unit for automatically playing alternating base tones.

In accordance with a further embodiment of the invention switching means for the re-programming of the programme memory are provided.

The switching means may not only comprise switches, but also sockets which are connected to each other by means of wires fitted with plugs. This enables the player to store his own programme.

In accordance with a further embodiment of the invention the programme memory is a random access memory (RAM) whose inputs are connected to the outputs of the counter and whose address inputs are connected to appropriate timing outputs of the rhythm unit. The output of the first 12-bit shift register, which corresponds to the initial position, is connected to the write input of the RAM and to the stop line of the clock generator during read-in. The comparator circuit is also connected to the stop line of the HF clock generator during playing via an AND circuit whose second input leads to the output of the chord memory.

By means of this circuit a random sequence of tones which are played at instants which coincide with the clock pulses of the rhythm unit can be stored and are available for reproduction after storage.

A further embodiment of the invention is characterized in that the outputs of the key switches of like tones are connected to the appropriate parallel input of the first 12-bit shift register via an OR-circuit.

This enables, for example, the complete lower keyboard to be used for chord accompaniment and to enable also the chords to be reproduced in an arbitrary inversion.

Still a further embodiment of the invention is characterized in that the second gate circuit comprises at least one frequency divider which is connected to the output of the gate circuit, which divider reduces the tone frequency by one or more octaves. A switch may be included which switches the number by which the frequency divider divides in a desired rhythm.

This makes it possible to alternately reduce the fundamental and/or the alternating bass tones by one or more octaves and to ensure that the frequency of the fundamental is always higher than that of the alternating bass.

Figure 2:
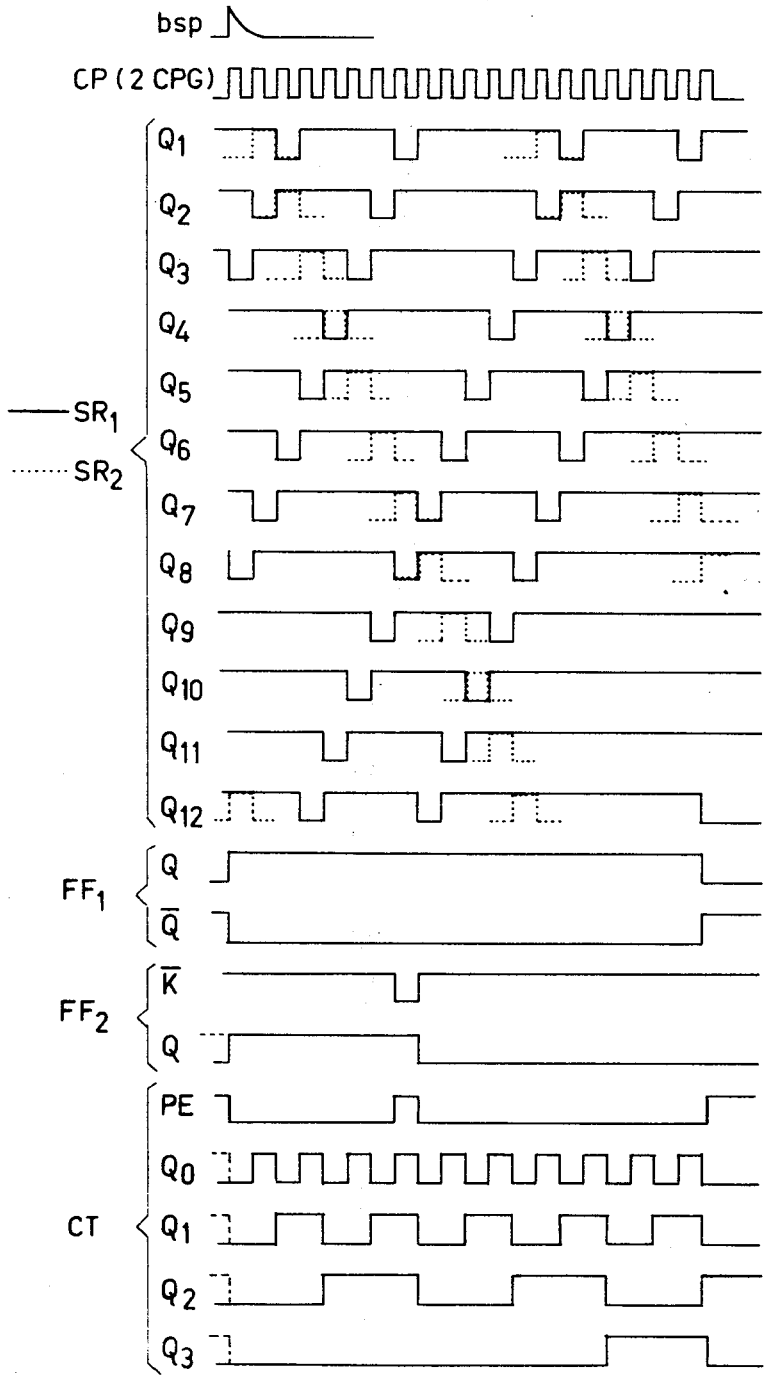
Figure 3:
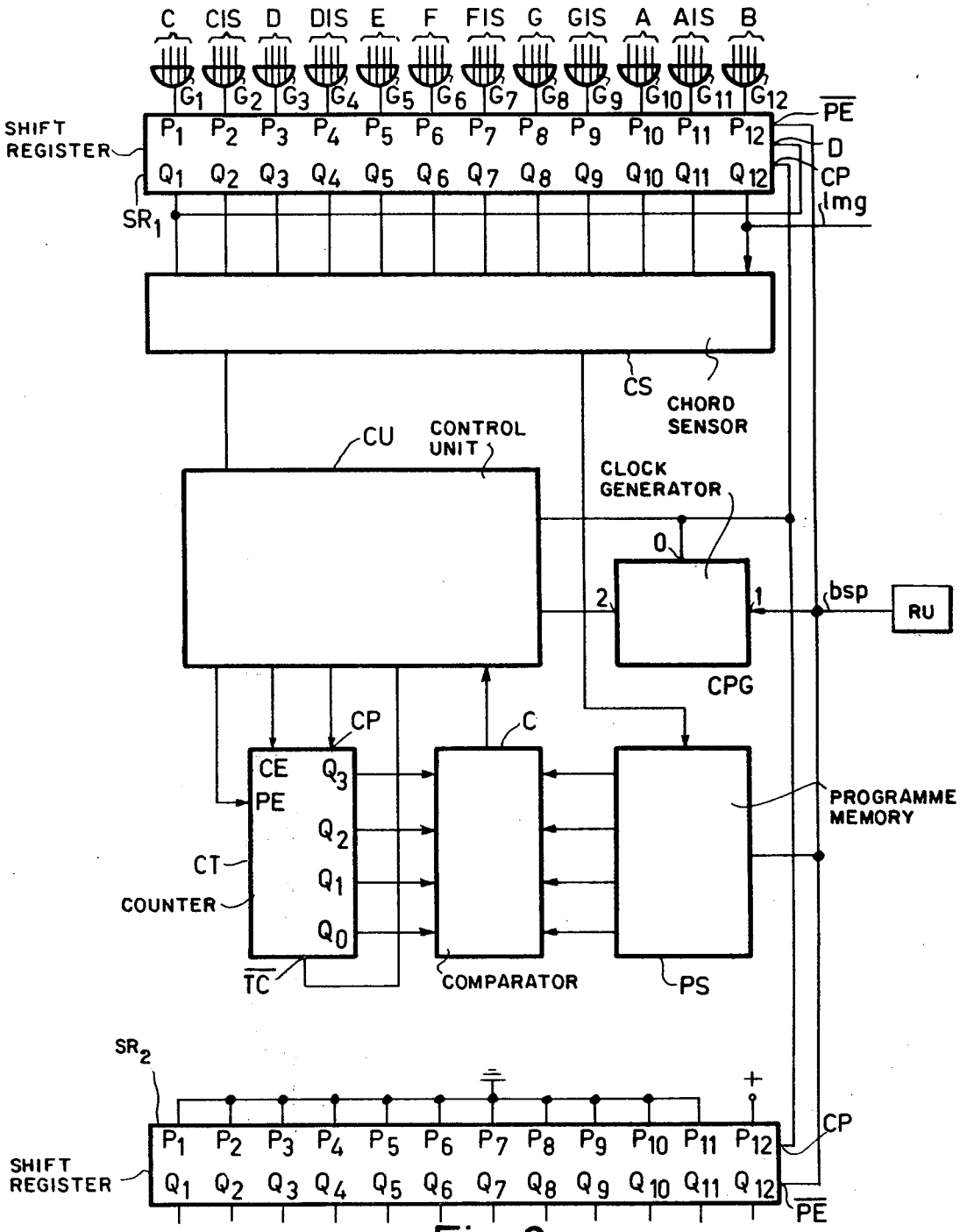
Figure 4:
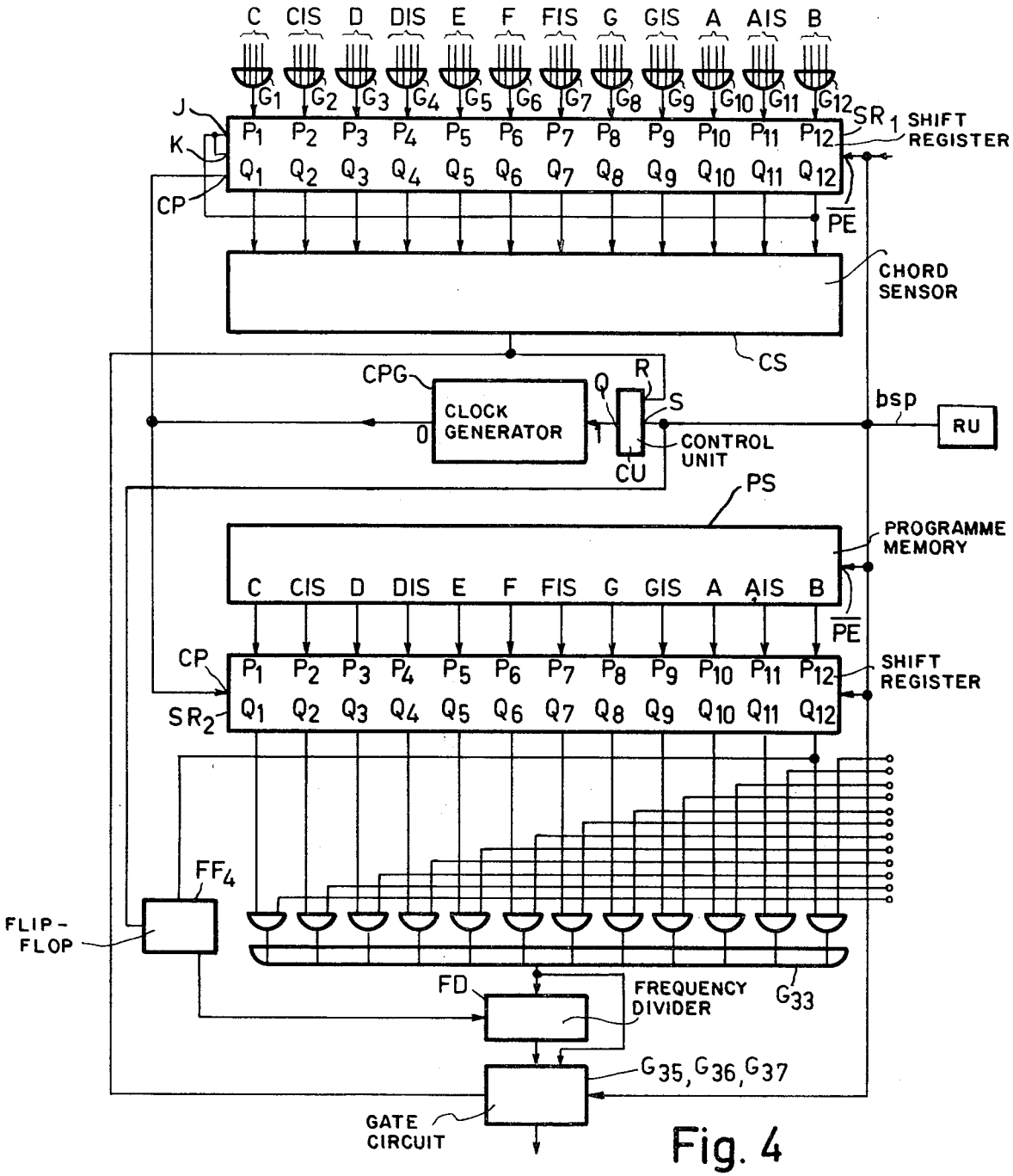
Figure 5:
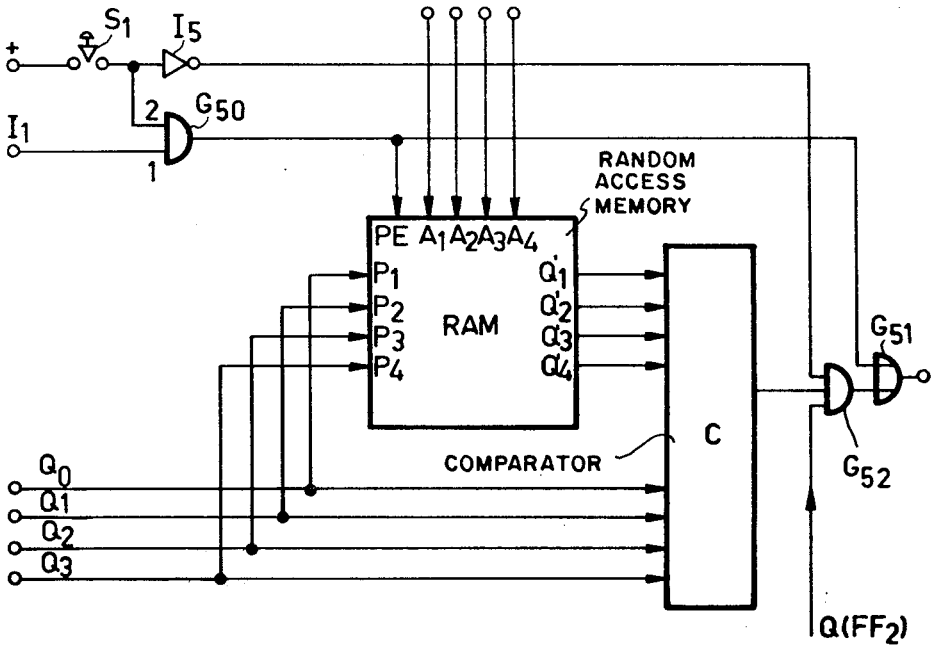
Figure 7:
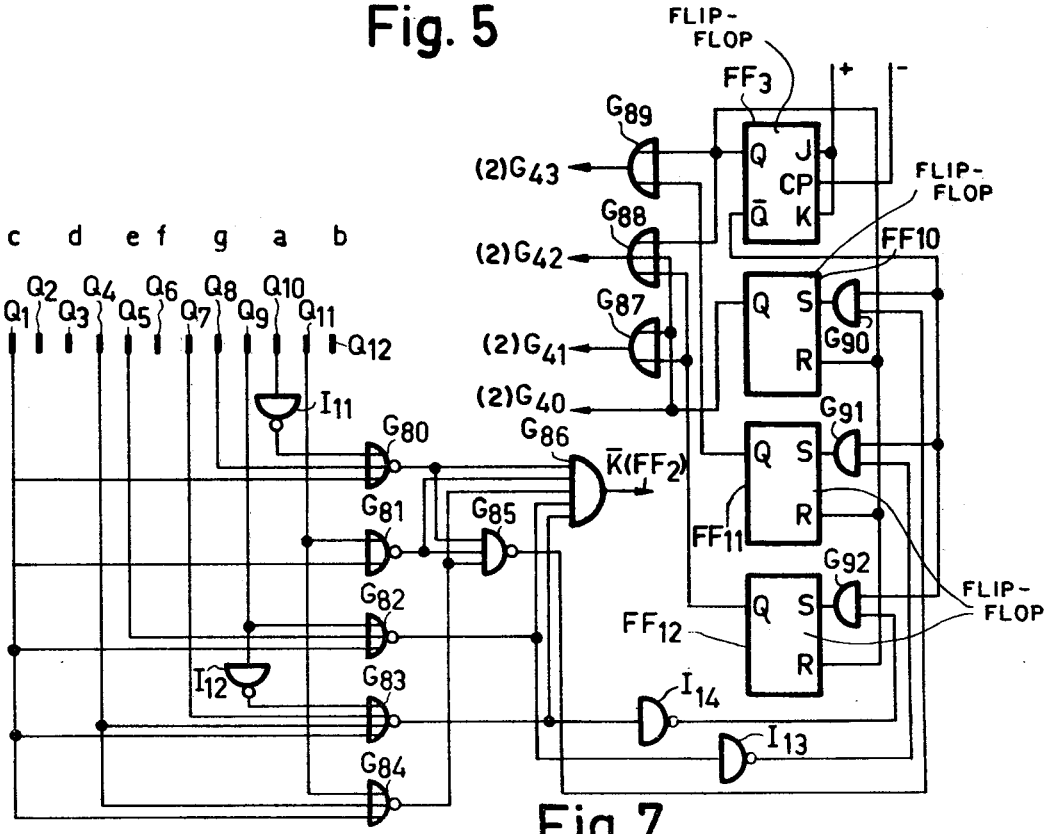
Figure 6:
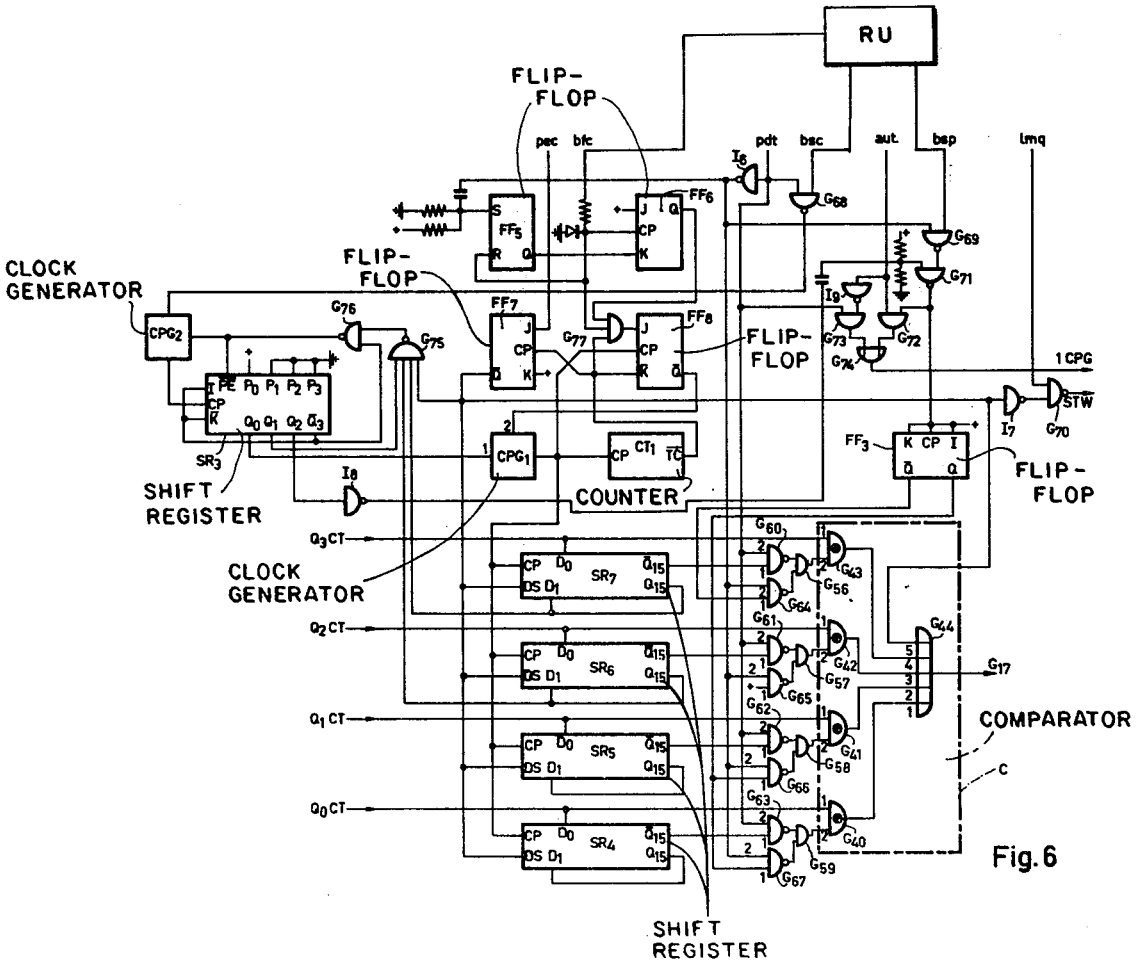
Figure 8:
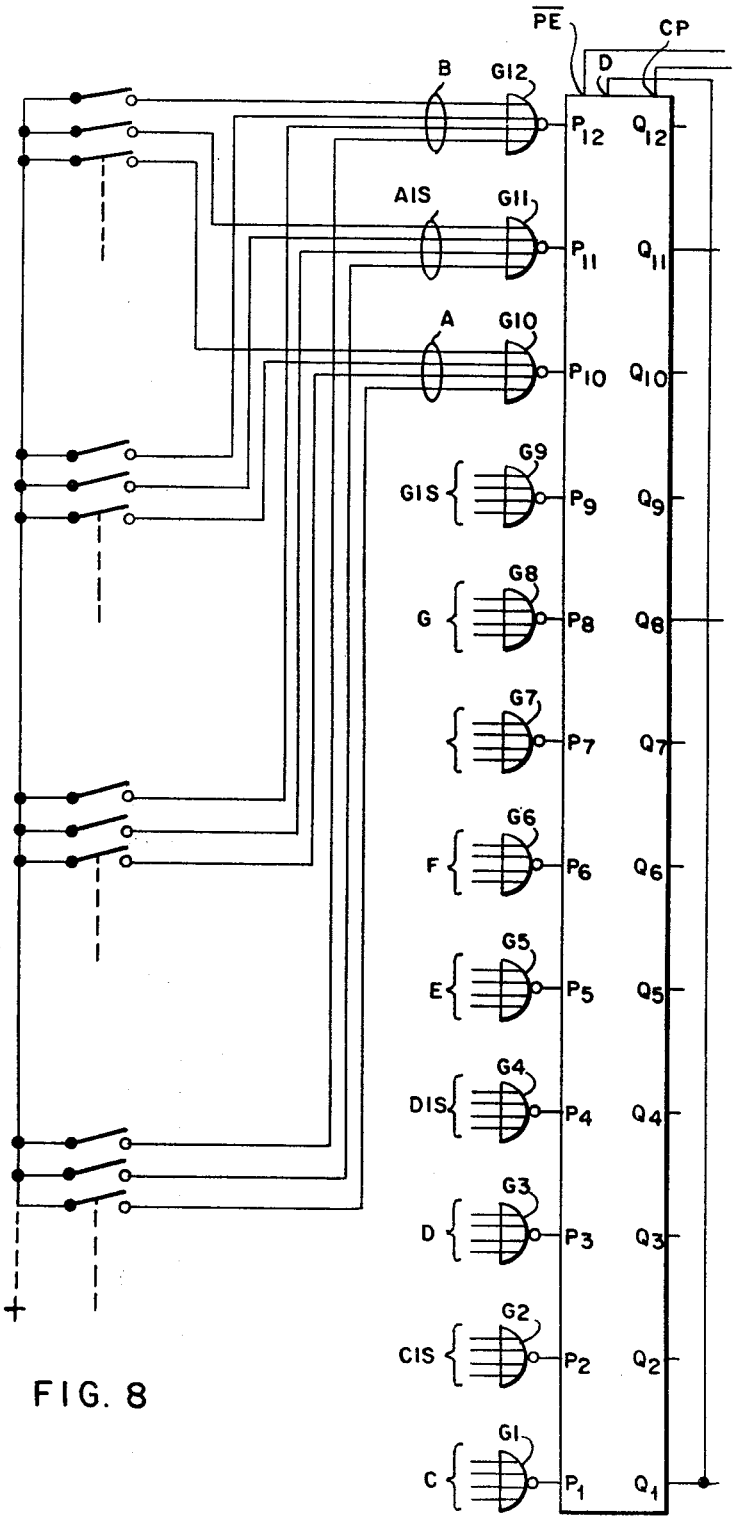

The invention will be described in more detail with reference to the following drawings and examples in which:

FIG. 1 shows a circuit for the alternating reproduction of fundamental bass and quint, FIG. 2 is a pulse-time diagram of this circuit, FIG. 3 is a circuit arrangement with a programme memory, FIG. 4 is a circuit arrangement with a programme memory without a comparator circuit, FIG. 5 is a block diagram of a circuit arrangement with a facility for programming by the player, FIG. 6 is a possible embodiment of this circuit, FIG. 7 is a circuit arrangement with an extended chord sensor and alternating bass change-over, and FIG. 8 shows a part of the keyboard and some of the connections to shift register $SR_1$ via gates $G_1$–$G_{12}$.

In FIGS. 1 and 8 the key switches of like tones C, C-sharp . . . B are each connected to an input of a gate circuit $G_1 \ldots G_{12}$ which takes the form of a NOR-circuit, equivalent to an OR-gate in the inverted layer employed, whose outputs are each assigned to an input $P_1 \ldots P_{12}$ of a first 12-bit shift register $SR_1$, which is connected as a ring. Those outputs, $Q_1 \ldots Q_{12}$ of the first 12-bit shift register $SR_1$ which correspond to the tones of the chords of a single key to be reproduced lead to the inputs of a chord sensor CS.

In this example this key is the C and the outputs $Q_1$, $Q_8$ and $Q_{11}$ which belong to the major third, minor third and seventh chords, lead to the chord sensor CS which in the present example consists of an inverter $I_1$, and two NAND-gates $G_{13}$ and $G_{14}$ respectively. Furthermore, an HF clock generator CPG is provided whose output 0 leads both to the clock input CP of the first 12-bit shift register $SR_1$ and to the clock input CP of a second 12-bit shift register $SR_2$ which is also connected in a ring. The outputs $Q_1 \ldots Q_{12}$ of register $SR_2$ are each connected to a first input 1 of a first gate circuit $G_{21} \ldots G_{32}$, which takes the form of an AND-gate to whose second input 2 the corresponding tone is applied. The outputs of the first gate circuits $G_{21} \ldots G_{32}$ lead to the inputs of a second gate circuit $G_{33}$ which takes the form of an OR gate.

The output 0 of the HF clock generator moreover leads to a first input 1 of the control unit CU and the clock input CP of the counter CT. The control unit CU comprises two flip-flops (bistable multivibrators) $FF_1$ and $FF_2$ of the JK-type, whose clock inputs CP are connected to the first input 1 of the control unit CU. The first output Q of the first flip-flop $FF_1$ is connected to its J-input and the load inputs $\overline{PE}$ of the two 12-bit shift registers $SR_1$ and $SR_2$ and to both the $\overline{J}$ and the $\overline{K}$-input of the second flip-flop $FF_2$ as well as the first input 1 of an AND-gate $G_{15}$. The second output $\overline{Q}$ of the first flip-flop $FF_1$ leads to the second input 2, the stop input, of the HF clock generator CPG.

The output of the chord sensor CS is connected both to a $\overline{K}$ input of the second flip-flop $FF_2$ which serves as a chord memory and to the first input of a NAND-circuit $G_{16}$ via an inverter $I_2$. The output of the NAND-circuit $G_{16}$ leads to the second input 2 of the AND-gate $G_{15}$, whose output is connected to the parallel enable input $\overline{PE}$ of the counter CT, whose preset inputs $P_0$, $P_1$, and $P_3$ are interconnected and connected to ground. The outputs $Q_0$, $Q_1$, $Q_2$ and $Q_3$ of the counter CT each lead to a first input 1 of an EXCLUSIVE OR circuit $G_{40}$, $G_{41}$, $G_{42}$ and $G_{43}$, which similarly to an OR circuit $G_{44}$, whose inputs 1, 2, 3 and 4 are connected to the outputs of the EXCLUSIVE OR circuits $G_{40} \ldots G_{43}$, belong to a comparator circuit C. The output of the OR circuit $G_{44}$ leads to the first input of an AND gate $G_{17}$, whose second input is connected to the output TC of the counter CT via an inverter state $I_3$, and whose output leads to the reset input $\overline{R}$ of the first flip-flop $FF_1$ via a differentiating circuit.

A switch which is constituted by a flip-flop $FF_3$, to whose input CP the base pulses are applied, is provided for alternately switching from fundamental bass to alternating bass, for which purpose its outputs, as stated, are connected to second inputs of the EXCLUSIVE OR circuits $G_{40}$, $G_{41}$ and $G_{43}$. Moreover, the bass pulses are applied to the reset input R of a fourth flip-flop $FF_4$, whose clock input CP is connected to the first input 1 of the AND gate 32.

The output Q of the chord memory $FF_2$ leads to the second input of the NAND circuit $G_{16}$ and input 5 of the OR circuit $G_{44}$.

The output of the second gate circuit $G_{33}$ is connected both to the clock input CP of a frequency divider FD, which divides its input frequency by two, and to the first input 1 of the AND gate $G_{35}$, whose second input 2 is connected to the output Q of the fourth flip-flop $FF_4$ via an inverter stage $I_4$, to which output Q the first input 1 of the AND gate $G_{36}$ is also connected. The output Q of the frequency divider FD is connected to the second input of the AND gate $G_{36}$.

The operation of this circuit is as follows: When a base pulse bsp arrives from the rbyth unit RU the HF clock generator CPG, which is disabled by the $\overline{Q}$ output of the first flip-flop $FF_1$, which is "H" (high), is caused to produce a clock pulse at its output, so that in the first 12-bit shift register $SR_1$, whose parallel enable input $\overline{PE}$ is initially "L" (low), receives an "L" at those parallel inputs for which the corresponding keys are depresed, and a "H" bit at the remaining parallel inputs. The second 12-bit shift register $SR_2$, whose parallel enable input PE is still also "L", receives an "H" at its parallel input $P_{12}$ and an "L" bit at the inputs $P_1 \ldots P_{12}$.Moreover, the flip-flops $FF_1$ and $FF_2$ are changed over, as STW and consequently the $\overline{K}$ input of $FF_1$ is "H" so that the bits entered into the 12-bit shift registers $SR_1$ and $SR_2$ are stored, because now the output Q of flip-flop $FF_1$ is "H" and the output $\overline{Q}$ is "L", so that the HF clock generator CPG is started via its second input 2.

Initially the output Q of the flip-flop $FF_2$ is either "L" when a chord is sensed, or "H" when this is not the case. Since terminal Q of flip-flop $FF_1$ is still "L", the output of $G_{15}$ is still also "L" so that the "L" information is transferred from the present inputs $P_0$, $P_1$, $P_2$ and $P_3$ of the counter CT to its outputs Q, $Q_1$, $Q_2$ and $Q_3$ upon the first transition from "L" to "H" of the HF clock pulse, i.e. the counter CT is reset to 0. Simultaneously the parallel enable input $\overline{PE}$ returns to so that the counter is advanced one position upon each subsequent HF clock pulse. Moreover Q of the flip-flop $FF_2$ when it should still be "L" will also become "H" at said transition.

Each subsequent HF clock pulse from the HF clock generator CPG shifts the chord pattern entered into the first 12-bit shift register $SR_1$, which pattern corresponds to the chord being held, for example the G major chord, so that the outputs $Q_8$, $Q_{12}$ and $Q_3$ are initially "L" one position to the left. In the present example the chord pattern reaches the position of the C major chord after seven steps, i.e. $Q_1$, $Q_5$ and $Q_8$ become "L", so that the output of NAND gate $G_{14}$ also becomes "L" and the chord has thus been sensed.

The same applies when the G-seventh chord GBDF is being held, depressing the combination GF being already sufficient.

The pattern "H" at output $Q_{12}$ in the second 12-bit shift register $SR_2$ has then arrived at the output $Q_7$ via the output $Q_1$, because this pattern is shifted to the right.

As soon as the chord is detected and the output of the NAND gate $G_{14}$ becomes "L", the chord is stored because the flip-flop $FF_2$ is changed over by the rising edge of the next HF clock pulse, so that terminal Q of flip-flop $FF_2$ becomes "L" again and remains in this state, even when the $\overline{K}$ input becomes "H" again. This transition no longer has any effect because the $\overline{J}$ and K inputs of flip-flop $FF_2$ remain "H" since the outut Q of flip-flop $FF_1$ remains "H". In the time interval in which after the rising edge of the $7^{th}$ pulse the output of the NAND gate $G_{14}$ becomes "L" and the output Q of the flip-flop $FF_2$ remains high until the rising edge of the $8^{th}$ clock pulse, the data-entry input $\overline{PE}$ of the counter CT becomes "L" so that the counter CT is reset. This $8^{th}$ clock pulse transfers the pattern "H" from the second 12-bit shift register $SR_2$ to the output $Q_8$, which corresponds to the tone G, of the AND gate $G_{28}$.

The HF clock generator CPG now keeps running and both shifts the chord pattern in the first 12-bit shift register $SR_1$ further, which has no further effect on the process, and shifts the charge pattern "H" in the second shift register $SR_2$, the counter CT, which has been reset 0", being advanced.

As shifting the chord pattern in the first 12-bit shift register $SR_1$ is no longer necessary when the chord has been found, it is as a matter of fact equally possible to interrupt the further supply of clock pulses to said 12-bit shift register $SR_1$ by disconnecting the clock pulse generator CPG from the clock pulse input CP by means of a switch or gate circuits.

When the bass pulse bsp appears switch $FF_3$ is set to such a position that its output Q is "L" and its output $\overline{Q}$ is "H" and that consequently the second inputs of the EXCLUSIVE OR gates $G_{40}$ and $G_{41}$ are "L" and the second inputs of the EXCLUSIVE OR gates $G_{42}$ and $G_{43}$ of the comparator circuit are "H".

When the state of the first inputs of these EXCLUSIVE OR gates is the same as the state of the second inputs, i.e. both "H" or both "L", the outputs are "L". This case occurs when the outputs $Q_0$ and $Q_1$ of the counter CT are "L" and the outputs $Q_2$ and $Q_3$ are "H", i.e. for counter position 12 (1100). The charge pattern "H" of the second 12-bit shift register $SR_2$ has then also been shifted 12 positions further since the chord was detected and then again appears at the output $Q_8$.

The output of the OR gate $G_{44}$ which also belongs to the comparator circuit C then becomes "L". As the count terminal TC of the counter CT is "L", the output of the third inverter $I_3$ is "H" and the output of the AND gate $G_{17}$ consequently becomes "L", so that a negative pulse appears at the reset input $\overline{R}$ of the flip-flop $FF_1$, as a result of which the output Q of the flip-flop $FF_1$ becomes "L" again, the parallel enable inputs $\overline{PE}$ of the counter CT and the two 12-bit shift registers $SR_1$ and $SR_2$ become "L". The output Q of the flip-flop $FF_1$ becomes "H", as a result of which the HF clock pulse generator is stopped and the circuit has returned to its initial position.

The 5th input of the OR gate $G_{44}$ which becomes "L" after the chord is detected, has been provided to prevent the flip-flop $FF_1$ from being stopped prematurely during chord sensing in the case of correspondence of the count of the counter CT and the number supplied by the flip-flop $FF_3$.

Each time that the charge pattern "H" passes the output $Q_{12}$ of the second 12-bit shift register $SR_2$, the flip-flop $FF_4$ changes over. When its output Q is "L" and consequently the output of the fourth inverter $I_4$ is "H", a tone G is transferred for reproduction by the AND gate $G_{35}$ with the aid of the OR gate $G_{37}$. Gate $G_{36}$ is then blocked because its first input 1 is "L".

In the present instance the output $Q_{12}$ of the second 12-bit shift register $SR_2$ is passed twice by the charge pattern "H", so that both the fundamental and the quint are reproduced in their original key.

When the fundamental is C, C sharp, D or D sharp, the charge pattern "H" passes the output $Q_{12}$ only once for the quint and consequently the flip-flop $FF_4$ remains set, so that the quints corresponding to these tones G, G sharp, A, A sharp, are transferred one octave down from the NAND gate $G_{36}$ to the OR gate $G_{37}$ via the frequency divider FD. When the next bass pulse bsp arrives the entire process is repeated, but since this bass pulse changes over the switch $FF_3$ so that its output Q becomes "H", the second inputs of the EXCLUSIVE OR gates $G_{40}$, $G_{41}$ and $G_{42}$ now become "H" and those of the EXCLUSIVE OR gate $G_{43}$ become "L". This situation corresponds to the digit (0111), i.e. to the quint D, so that now the charge pattern "H" of the second 12-bit shift register remains at the output $Q_3$ of said register. As in the meantime the fourth flip-flop $FF_4$ has been reset by the bass pulse bsp, and the charge pattern does not pass the output $Q_{12}$ of the second 12-bit shift register, the flip-flop $FF_4$ remains in this state and the AND gate $G_{35}$ is blocked so that the tone frequency which has been divided by 2 by the frequency divider FD, is transferred for reproduction from the AND gate 36 by means of the OR gate $G_{37}$. This is the case when the alternating bass i.e. the quint is reproduced whose frequency is consequently always below the fundamental bass in a musically correct manner.

If no chord is detected, the counter CT counts further till the end, upon which the TC output of the counter CT becomes "H", i.e. the output of the third inverter becomes "L", so that the flip-flop $FF_1$ is also reset and the HF clock generator CPG is stopped. The above process is further clarified in FIG. 2 by means of pulse time diagrams while it is to be noted that the charge patterns are shifted in the direction from $Q_{12}$ to $Q_1$ in the first 12-bit shift register $SR_1$ and from $Q_1$ to $Q_{12}$ in the second 12-bit shift register.

In FIG. 3 the switch $FF_3$ is replaced by a programme memory PS which is switched one position further by each bass pulse bsp. This enables the final count of the counter CT to be selected differently for each bass pulse so that it is also possible to automatically reproduce a bass pattern, for example, required for playing a boogie-woogie and which in the C key consists of the sequence, c, e, g, a, b flat, a, g, e.

In the circuit arrangement of FIG. 4 the control unit CU consists of an on/off switch which may for example take the form of an R-S flip-flop. This circuit CU is set to such a position by the bass pulse bsp that the HF clock generator CPG is started and when a chord is detected is reset via its reset input R by means of the pulse at the output of the chord sensor CS.

Furthermore, a programme memory is provided having 12 outputs C . . . B, which each correspond to a tone of an octave, and which are connected to the corresponding parallel inputs $P_1 \ldots P_{12}$ of the second 12-bit shift register $SR_2$. This shift register $SR_2$ receives a charge pattern "H" upon the occurrence of a bass pulse which corresponds to the desired tone in that key in which the chords in the chord sensor CS are detected. The remainder of the circuit corresponds to the circuit arrangement of FIG. 1.

The circuit arrangement of FIG. 5 enables an arbitrary bass melody to be stored. For this purpose the programme memory of FIG. 3 is replaced by a random access memory (RAM).

For this the outputs $Q_0$, $Q_1$, $Q_2$ and $Q_3$ of the counter CT, which are already connected to the first inputs of the comparator circuit C, are moreover connected to the set inputs of the RAM. The address inputs $A_1 \ldots A_4$ are operated by the rhythm unit and the outputs $Q_1' \ldots Q_4'$ are connected to the second inputs of the comparator circuit C. The parallel enable input PE is connected to the output of the AND gate $G_{50}$, whose first input 1 is connected to the output of the first inverter $I_1$ of the chord sensor of FIG. 1 and whose second input 2 can be connected to the positive supply voltage via a switch $S_1$.

For programming the switch 1 is depressed and the melody to be programmed is played in C. When the first bass pulse appears the first key is depressed and the circuit will operate as described with reference to FIG. 1. The first 12-bit shift register $SR_1$ is loaded with one bit via an input which corresponds to the key which is depressed. The bit is shifted while the counter CT counts the number of shifts. As the bit arrives at the first output $Q_1$ of the first 12-bit shift register, the first input 1 of the AND gate $G_{50}$ becomes "H" via the inverter $I_1$ of the chord sensor CS and thus the number at the outputs $Q_1 \ldots Q_3$ of the counter CT is entered into the RAM and by means of the OR gate $G_{51}$ the HF clock generator CPG is stopped. Upon the next bass pulse bsp this process is repeated and the number is stored at the next location of the RAM. Simultaneously the tone corresponding to the depressed key is released for reproduction by the corresponding output of the second 12-bit shift register $SR_2$ by means of the associated AND gate ($G_{21} \ldots G_{32}$).

For reproduction the switch $S_1$ is opened and the same process takes place, but the stop pulse for the clock generator is no longer supplied via the AND-gate $G_{50}$ because the second input 2 is no longer "H", but from the output of the comparator circuit C by means of the AND gate $G_{52}$ and the OR gate $G_{51}$ when the count of the counter CT corresponds to the preset number at the RAM outputs.

The diagram of FIG. 6 shows how a circuit arrangement as described with reference to FIG. 5 can be designed using simple means.

This circuit is included between the outputs $Q_0$, $Q_1$, $Q_2$, $Q_3$ of the counter CT and the first inputs 1 of the gates $G_{40}$, $G_{41}$, $G_{42}$ and $G_{43}$ of the comparator circuit C in FIG. 1, this comparator circuit C and the flip-flop FF3 also being shown for clarity. Moreover, the drive of the HF clock generator CPG and the flip-flop $FF_3$ by the bass pulse has been modified.

For change-over between alternating bass and programme bass mode and for the actuation of the storage process (switch $S_1$ of FIG. 5) in this embodiment the normal pedal keyboard of the organ is used, which during automatic play has no other function.

There are three possible modes of operation when automatic bass generation is being employed:

(a) alternating bass reproduction (b) programming in a bass sequence for subsequent automatic reproduction and (c) automatic reproduction off the sequence so programmed.

In all of these modes an "H" is applied to input "aut". In mode (b) an "H" is applied additionally to input "pdt" and "pec" by arranging that depression of a particular pedal, for example the C pedal, actuates switches to cause these inputs to be applied to the arrangement.

In mode (c) an "H" is additionally applied to input "pdt" only, for example by arranging that depression of any pedal other than the C-pedal actuates a switch to cause their input to be applied to the circuit.

In mode (a) the pedals are not depressed so that the signal pdt which is derived from the pedal contacts remains "L", so that the first input 1 of the NAND gate $G_{68}$ does not transfer the bass clock pulses bsc. However, by means of the inverter $I_6$ the first input 1 of the NAND gate $G_{69}$ becomes "H" so that the bass pulses bsp, which are obtained from the bass drum control of the rhythm unit RU and which consequently appear at the beginning of each measure, are transferred and are applied to the flip-flop $FF_3$ via the NAND gate $G_{71}$ and further to the HF clock generator CPG of FIG. 1 via the gates $G_{72}$ and $G_{74}$. The second inputs of the NAND gates $G_{60}$, $G_{61}$, $G_{62}$ and $G_{63}$ are also "L" (pdt = "L"), so that the gates are blocked, while the NAND gates $G_{64}$, $G_{65}$, $G_{66}$ and $G_{67}$ are also "H" via the inverter $I_6$ and consequently transfer the signals from the outputs Q and Q of the flip-flop $FF_3$ to the second inputs 2 of the EXCLUSIVE OR gates $G_{40} \ldots G_{43}$ via the OR gates $G_{56} \ldots G_{59}$, so that the process described with reference to FIG. 1 takes place.

For programming one of the pedal keys, which in this case are not used for normal play, for example the C-key is depressed. In that case pdt becomes "H" and the "pec" input also becomes "H" owing to a second switch which is actuated by said C-key. As pdt and thus the first input 1 of the NAND gate $G_{68}$ become "H", the uniformly timed bass clock pulses bsc (from the rhythm unit RU) are transferred, the number of these bass clock pulses being dependent on the selected measure and being a maximum 8 pulses per measure. This bass clock pulse bsc switches a second HF clock generator $CPG_2$ and its first pulse results in an "H" bit at the first input $P_0$ of a 4-bit shift register $SR_3$ and an "L" bit at the other inputs.

At the first outputs $Q_0$ an "H" appears so that a clock pulse generator $CPG_1$ is caused to supply a pulse by which a 4-bit binary counter $CT_1$ and four 16-bit shift registers $SR_4 \ldots SR_7$ are set one position further. Upon the next clock pulse from the HF clock generator $CPG_2$ the output $Q_1$ of the 4-bit shift register $SR_3$ becomes "H". When the number at the outputs $Q_{15}$ of the four 16-bit shift registers $SR_4$ to $SR_7$ is $\geqq 12$, i.e. when a pause instead of a tone is stored, the outputs $Q_{15}$ of $SR_6$ and $SR_7$ are "H". In the case where no data entry takes place, $\overline{Q}$ of flip-flop $FF_7$ is "H" so that all inputs of NAND gate $G_{75}$ become "H" and the output consequently becomes "L". As the second input of NAND gate $G_{76}$ is "H" and the first input becomes "L", the second HF clock generator $CPG_2$ is switched off. If the number at the outputs of the 16-bit shift registers $SR_4$ to $SR_7$ is smaller than 12, the output of the NAND gate $G_{75}$ remains "H" and the HF clock generator $CPG_2$ keeps running until the second input 2 of the NAND gate $G_{76}$ also becomes "L" upon the appearance of the charge pattern "H" at the output $Q_3$, so that $\overline{Q_3}$ becomes "L".

Storage is effected as follows:

At the beginning of each measure the rhythm unit RU supplies a beginning-of-measure pulse bfc which is derived from the voltage of the indicator lamp which indicates the beginning of a measure and which is present in each rhythm unit. These beginning-of-measure pulses bfc each time change over the flip-flop $FF_6$. Upon every second clock pulse flip-flop $FF_8$ is changed over via the output Q of the flip-flop $FF_6$ which becomes "H", because at the same time the clock generator $CPG_1$, as described above, supplies a clock pulse to the clock input CP of the flip-flop $FF_8$. As a result of this, the clock generator $CPG_1$ which normally is only allowed to supply a single pulse via its first input, is switched on via its second input 2 until the 4-bit binary counter $CT_1$, which is driven at a high frequency by said generator, as well as the 16-bit shift registers $SR_4$ to $SR_7$, have reached their final positions, after which via the terminal count output $\overline{TC}$ of this counter $CT_1$ the $\overline{K}$-input of the flip-flop $FF_8$ becomes "L" and flip-flop $FF_8$ is reset.

The RS flip-flop $FF_5$ is set upon change-over to programme bass, as a result of which pdt became "H", so that the flip-flop $FF_6$ could change over at the beginning of the next measure. The circuit is now ready for programming and flip-flop $FF_5$ is reset by the next beginning-of-measure pulse bfc.

As stated above, the C pedal key is depressed for programming and the pec input is consequently "H". At the beginning of the next measure the 4-bit shift register $SR_3$ causes the clock pulse generator $CPG_1$ to supply a pulse so that the 4-bit binary counter $CT_1$, as well as the four 16-bit shift registers $SR_4$ to $SR_7$, assume their initial positions, as a result of which terminal $\overline{TC}$ of counter $CT_1$ becomes "H" again and flip-flop $FF_7$ changes over because pec is "H".

As a result the output $\overline{Q}$ of flip-flop $FF_7$ and thus the data entry inputs DS of the 16-bit shift registers $SR_4$ to $SR_7$ become "L", so that the inputs $D_1$ are blocked and the ring connection between the last output $Q_{15}$ of the last flip-flop and the input of the first flip-flop of these registers is interrupted and these inputs are connected to the outputs $Q_0$ to $Q_3$ of the counter CT via $D_0$. At the same time the clock pulse bsc, upon the passage of the "H" charge pattern at the output $Q_2$, has caused the shift register $SR_3$ to supply an "H" pulse to the HF clock generator CPG (see FIG. 1) via the inverter $I_8$, the NAND gate $G_{71}$, the NAND gate $G_{72}$ and the OR gate $G_{74}$, as a result of which the process described with reference to FIG. 1 is initiated. The shift register $SR_1$ now starts to shift the charge pattern which corresponds to the tone played on the lower keyboard, the charge pattern being simultaneously shifted in the shift register $SR_2$ and the counter CT counting every step. As soon as the charge pattern appears at the first output $Q_1$ of the first 12-bit shift register $SR_1$, the output lug of the first inverter $I_1$ becomes "H" and via the NAND-gate $G_{70}$, whose second input 2 is "H", while Q of flip-flop $FF_7$ is "L", supplies a pulse stw to the $\overline{K}$-input of the first flip-flop $FF_1$ so that upon the next pulse the HF clock generator CPG changes over the flip flop $FF_1$ and thus renders itself inoperative. The count of counter CT which is then reached exactly corresponds to the sequence number of the tone, 1 for C, 2 for C sharp, etc. This number is stored in binary form in the 16 bit shift registers $SR_4$ to $SR_7$. If no tone is played, the counter CT counts to position 15 and switches itself off by means of a pulse via the output CT and flip-flop $FF_1$, so that the number 15 (1111) is stored.

Upon the next clock pulse bsc this process is repeated, i.e. the clock generator $CPG_1$ is again caused to supply a single pulse so that the 4-bit binary counter $CT_1$ and the charge patterns in the 16-bit shift registers $SR_4$ to $SR_7$ are advanced one position and the next number is stored.

For this storage 16 positions are available. After two measures the flip-flop $FF_7$ is reset by means of a pulse from the output $\overline{TC}$ of the 4-bit binary counter $CT_1$. The foot may now be removed from the C pedal key during a time of 2 measures because during the next 16 clock pulses bsc the $\overline{Q}$ output of the flip-flop $FF_7$ remains "H" and the shift registers $SR_4$ to $SR_7$ are again connected to form a ring and the storage facility is inhibited. Upon the $16^{th}$ pulse the flip-flop $FF_7$ is again reset by the final-position pulse at the $\overline{TC}$ output of the 4-bit binary counter $CT_1$ and the storage process is repeated.

For storage it is necessary to play exactly in time so that a key is depressed when the clock pulses bsc appear. As during storage the shift registers $SR_1$ and $SR_2$ operate normally, as described with reference to FIG. 1, the melody will sound as played in the C-key.

During reproduction pdt is "H" and upon the first beginning-of-measure pulse bfc, as already described, the 4-bit binary counter $CT_1$ as well as the four 16-bit shift registers $SR_4$ to $SR_7$, through change-over of the flip-flops $FF_6$ and $FF_8$, are reset to their initial states by the clock generator $CPG_1$, which supplies pulses of very high frequency in the free-running mode. This process is not only necessary to obtain the correct initial position, but it is also necessary for those cases in which the number of steps during two measures is smaller than 16, as for example in triple time, since then 4 positions in the 16-bit shift registers $SR_4$ to $SR_7$ can remain unused. If in the meantime the clock generator $CPG_2$ has shifted the charge pattern in the 4-bit shift register $SR_3$ to the output $Q_2$, a starting pulse is applied to the first input 1 of the HF clock generator CPG via the inverter $I_8$, the NAND gate $G_{71}$, the AND gate $G_{72}$ and the OR gate $G_{74}$, and the first 12-bit shift register $SR_1$ starts shifting, the chord being held until the chord is detected and the charge pattern in the second 12-bit shift register $SR_2$ appears at the output Q which corresponds to the fundamental of the chord which is held. The counter CT is then reset and the charge pattern in the second 12-bit shift register $SR_2$ is shifted further until the number at the outputs $Q_1 \ldots Q_3$ of the counter CT corresponds to the number at the $\overline{Q}_{15}$ outputs of the 16-bit shift registers $SR_4$ to $SR_7$. The output of the OR gate $G_{44}$ then becomes "H" and via the AND gate $G_{17}$ it resets the flip-flop $FF_1$ and stops the HF clock generator CPG, while the correct tone is released for reproduction via the corresponding AND gates $G_{21} \ldots G_{32}$.

Upon the next bass clock pulse bsc the clock generator $CPG_1$ supplies only one pulse so that the 16-bit shift registers $SR_4$ to $SR_7$ are shifted only one position further and the described process is repeated.

With the described circuit arrangement it is necessary for reproduction to depress a chord which belongs to the stored melody, which may be musically undesirable. This is owing to the necessity to reset the counter CT after a chord has been detected in order that the charge pattern in the second 12-bit shift register $SR_2$ can be shifted to its position which corresponds to number stored in the memory. This reset takes place when the output of NAND gate $G_{14}$ becomes "L". Therefore, it is possible to substantially simplify the operation by merely pressing the fundamental of the key of the stored accompaniment to be played and taking care that when the corresponding charge pattern appears at the output $Q_1$ of the first 12-bit register $SR_1$ by means of a NAND gate $G_{18}$ to whose first input the 1mq signal from the output of the inverter $I_1$ is applied and whose second input is made "H" when the memory is switched on during reproduction, as is shown in dashed lines in FIG. 1.

Alternating bass play is only possible for simple chords such as the major chord, minor chord and seventh chord by means of the circuit arrangement of FIG. 1. For diminished seventh chords and augmented chords, chord detection is impossible, while a minor seventh chord does lead to chord detection but does not correctly indicate the fundamental. In the case of the minor seventh chord of b, a sharp and a the major chord d, f sharp, a or c sharp, f, g sharp or c, e, g is found and consequently the d, c sharp or c is played as fundamental bass and a, g sharp or g instead of f sharp, f or e respectively as alternating bass. Moreover, it is only possible to use one note as alternating bass, for example the quint.

FIG. 7 shows how the circuit arrangement of FIG. 1 can be employed for playing major, minor and seventh chords as well as augmented chords, diminished seventh chords and minor seventh chords.

In this case the chord sensor CS consists of NOR gates $G_{80} \ldots G_{84}$ and two inverter stages $I_{11}$ and $I_{12}$. The gate $G_{80}$ senses the major and minor chords by ascertaining whether in addition to the fundamental the quint is present, in which case its output becomes "L". In order to prevent a chord from being also detected in the case of the above-mentioned seventh chords of b, a sharp and a, an inverter $I_{11}$ is added to the output $Q_{10}$, which corresponds to the a, of the first 12-bit shift register $SR_1$, which inverter causes the gate $G_{80}$ to be blocked in the presence of the tone a. Gate $G_{81}$ identifies the seventh chords, $G_{82}$ the augmented chords and $G_{83}$ the diminished seventh chords. The inverter $I_{12}$ is provided to prevent a seventh chord from being identified as a diminished seventh chord, because the major third, the quint and the seventh of this chord form a diminished seventh chord and would consequently give rise to incorrect chord detection in the case of seventh chords of b, a sharp, a and g sharp. Finally, the NOR gate $G_{84}$ identifies the minor seventh chords. The outputs of these gates $G_{81} \ldots G_{84}$ are all connected to an input of the AND gate $G_{86}$, whose output leads to the $\overline{K}$ output of the chord memory $FF_2$.

It is assumed that the quint is taken as alternating bass for the major, the minor, the seventh and minor seventh chords, the augmented quint for the augmented chords and the augmented fourth for the diminished seventh chords. For each of these alternating bass tones the corresponding outputs of the gates $G_{85}$, $G_{82}$ and $G_{83}$ are connected to the set inputs of the RS flip-flops $FF_{10}$, $FF_{11}$ and $FF_{12}$, whose reset inputs are influenced by the Q output of the flip-flop $FF_3$. The outputs Q of flip-flop $FF_3$ and Q of the flip-flops $FF_{10}$, $FF_{11}$ and $FF_{12}$, as indicated, are connected to the inputs of the OR gates $G_{87} \ldots G_{89}$, whose outputs are connected to the second inputs of the EXCLUSIVE OR gates $G_{40} \ldots G_{43}$.

When a chord is detected, the fundamental is played at the first measure, as described hereinbefore, while the second 12-bit shift register $SR_2$ makes 12 further steps, because the output Q of the flip-flop $FF_3$ with the aid of the OR gates $G_{88}$ and $G_{89}$ together with the OR gate $G_{87}$ and the output Q of flip-flop $FF_{10}$ give the binary number 12 (1100).

Upon the second measure $FF_3$ changes over and when a quint appears a pulse is applied to the set input S of flip-flop $FF_{10}$ via the NAND gate $G_{85}$ and the AND gate $G_{90}$ upon the next HF clock pulse, so that the flip-flop $FF_{10}$ changes over and the outputs of the OR gates $G_{87}$, $G_{88}$ and $G_{89}$ become "H" and together with the output Q of flip-flop $FF_{10}$ give the number 7 (0111). Upon the next clock pulse the flip-flop $FF_{10}$ is reset by the output of the flip-flop $FF_3$ via its reset input R.

A similar process takes place in the case of an augmented chord, the flip-flop $FF_{11}$ being changed over via the output of the NOR gate $G_{82}$ and the inverter $I_{13}$ and the outputs of the OR gates $G_{87} \ldots G_{89}$ together with the output Q of the flip-flop $FF_{10}$ giving an 8 (1000), so that an augmented quint is played as alternating bass.

Finally, in the case of a diminished seventh chord via the output of the NOR gate $G_{83}$ and the inverter $I_{14}$ and the flip-flop $FF_{12}$ a 6 (0110) is supplied at the outputs of the gates $G_{87} \ldots G_{89}$ with the output Q of the flip-flop $FF_{10}$, so that the augmented fourth is played as alternating bass.

It is evident that the minor third may also be taken as alternating bass, for example the minor chord, for which purpose the circuit arrangement is to be adapted in a similar way.

What is claimed is:

1. A device for automatically playing a tonal accompaniment in electronic musical instruments equipped with key switches and a rhythm unit, at least one tone of a chord being held as a chord pattern and becoming available in a predetermined sequence in the selected rhythm, said device comprising, a first 12-bit shift register connected in a ring and having plural inputs and plural outputs, means coupling the key switches of a given octave to the inputs of the first shift register, the chord pattern being stored in the first shift register upon receipt of each bass pulse of the rhythm unit, a chord sensor which determines the chord type and has plural inputs and an output, means for coupling those outputs of the first shift register, to which the tones of the chords of a single key to be reproduced correspond, to the inputs of the chord sensor, a second 12-bit shift register connected in a ring and having a plurality of parallel inputs and plural outputs each corresponding to one tone of an octave, a high frequency clock generator having an output connected to a clock input of the first 12-bit shift register for shifting the chord pattern one position further with each clock pulse, and also connected to a clock input of the second 12-bit shift register into which a single bit is entered upon receipt of each bass pulse via its 12 parallel inputs, which bit is shifted one position further with each clock pulse of the clock generator, a first gate circuit means having a plurality of first and second inputs and output means, means connecting the outputs of the second shift register each to a first input of the first gate circuit means, means for applying the tone corresponding to the output of the second shift register to the second inputs of said first gate circuit means, means coupling the output means of the first gate circuit means to an input of a second gate circuit at whose output a tone is available, a control section connected to the high frequency clock generator and to the output of the chord sensor, the clock input of the first 12-bit shift register being disconnected from the high frequency clock generator when a chord is detected, means for applying the rhythm unit bass pulses to a first input of the high frequency clock generator which is thereby rendered operative, and means coupling the control section to the high frequency clock generator so as to make the clock generator inoperative as soon as the bit in the second 12-bit shift register reaches the position which corresponds to the desired tone in the key which is dictated by the chord.

2. A device as claimed in claim 1, wherein the control section includes a chord memory which stores the detected chord and further comprising a counter having a reset input and a clock input, means coupling an output of the chord memory via a second output of the control section to the reset input of the counter, whose clock input is also connected to the high frequency clock generator, and to a comparator circuit having first inputs connected to the corresponding outputs of the counter and having second inputs connected to a switch which is switched over by each bass pulse, and means connecting the output of the comparator circuit to a third input of the control section so that the clock generator is alternately disabled upon reaching a counter position which corresponds to the fundamental or another tone respectively.

3. A device as claimed in claim 1 further comprising a counter having a reset input and a clock input connected to the clock generator, a programme memory having a first input to which the bass pulses are applied which each advance the programme memory one position, means coupling a second output of the control section to the reset input of the counter and to a comparator circuit having first inputs connected to corresponding outputs of the counter and second inputs connected to outputs of the programme memory, and means connecting the output of the comparator circuit to a third input of the control section so that the clock generator is alternately disabled upon reaching a counter position which corresponds to the fundamental or another tone respectively.

4. A device as claimed in claim 1 wherein the control section comprises an on/off switch which renders the clock generator operative with each bass pulse and which renders it operative again via the chord sensor output when the chord is detected, a programme memory being provided having 12 outputs which each correspond to one tone of an octave and are connected to the corresponding parallel inputs of the second 12-bit shift register, and means for applying the bass pulses to be transferred to an input of said programme memory so that the tone output corresponding to the relevant instant is released.

5. A device as claimed in claim 1, wherein the rhythm unit includes a decoder with outputs, and means connecting the decoder outputs corresponding to the various rhythm clock-pulse patterns in the rhythm unit to the parallel input of the second 12-bit shift register which corresponds to the desired tone.

6. A device as claimed in claim 3 further comprising switching means for reprogramming the programme memory.

7. A device as claimed in claim 3 wherein the programme memory comprises a random access memory (RAM) having inputs connected to the outputs of the counter and address inputs connected to appropriate timing outputs of the rhythm unit, means connecting the output of the first 12-bit shift register which corresponds to the initial position to the write input of the random access memory and to the stop line of the clock generator during read-in, and means connecting the comparator circuit to a stop line of the clock generator during playing via an AND circuit having a second input connected to the output of the chord memory.

8. A device as claimed in claim 1 characterized in that the outputs of the key switches of like tones are connected to the appropriate parallel input of the first 12-bit shift register via an OR-circuit.

9. A device as claimed in claim 1 further comprising, at least one frequency divider connected to the output of the second gate circuit, which divider reduces the tone frequency by one or more octaves, and a switch which switches the number by which the frequency divider divide in a desired rhythm.

10. A device as claimed in claim 4 further comprising switching means for reprogramming the programme memory.

* * * * *